US005295535A

United States Patent [19]

Boles et al.

[11] Patent Number: 5,295,535

[45] Date of Patent: Mar. 22, 1994

[54] COVER FOR AN OBSERVATION WELL

[75] Inventors: Claude C. Boles, Winnetka; Lester D. Boles, Chicago, both of Ill.

[73] Assignee: The Boles Company, Inc., Northfield, Ill.

[21] Appl. No.: 867,364

[22] Filed: Apr. 13, 1992

[51] Int. Cl.[5] ..... E21B 33/02; E03F 5/08

[52] U.S. Cl. ..... 166/81; 166/92; 52/20; 404/25

[58] Field of Search ..... 166/75.1, 92, 81; 137/263.1, 312; 141/86; 220/86.1, 71; 405/45, 54, 129, 154; 404/25; 52/20

[56] References Cited

U.S. PATENT DOCUMENTS

| | | | |
|---|---|---|---|
| 4,187,647 | 2/1980 | Hall . | |
| 4,188,151 | 2/1980 | Hall . | |
| 4,255,909 | 3/1981 | Soderstrom . | |
| 4,302,126 | 11/1981 | Fier . | |
| 4,325,405 | 4/1982 | Christo . | |
| 4,475,844 | 10/1984 | Arntyr et al. . | |
| 4,593,714 | 6/1986 | Madden . | |
| 4,655,361 | 4/1987 | Clover et al. | 220/86.1 X |
| 4,659,251 | 4/1987 | Petter et al. . | |
| 4,706,718 | 11/1987 | Milo . | |
| 4,762,440 | 8/1988 | Argandona . | |
| 4,763,806 | 8/1988 | Podgers et al. | 220/86.1 |
| 4,793,387 | 12/1988 | LeBlanc et al. . | |
| 4,809,866 | 3/1989 | Crocker | 220/86.1 |
| 4,842,443 | 6/1989 | Argandona . | |
| 4,896,705 | 1/1990 | Podgers et al. . | |
| 4,971,149 | 11/1990 | Roberts | 160/75.1 X |
| 5,010,957 | 4/1991 | Kenner | 166/75.1 X |
| 5,114,271 | 5/1992 | Sunderhaus et al. | 404/25 X |
| 5,208,320 | 7/1991 | Gaudin et al. | 404/25 |

OTHER PUBLICATIONS

Shell Engineering Sketch Pad: *Observation & Monitoring Sensor Well Details*; Oct., 1989.

Petroleum Equipment Inst.: *Recommended Practices For Installation Of Underground Liquid Storage System*; p. 13; 1989.

American Petroleum Institute Industry Standards: *API Recommended Practice* 1615; pp. 18-20.

Petroleum Marketer: *Spill Containment Unit Utilizes A Stroke Pump Instead Of Drain Valve*; p. 26; Mar.-Apr., 1991.

The Journal of Petroleum Marketing: *Improved Sump*; p. 48, Sep. 1990, The Boles Test And Retrieval Sump Brochure.

Shaw Aero Brochure.

*Primary Examiner*—Ramon S. Britts
*Assistant Examiner*—Frank S. Tsay
*Attorney, Agent, or Firm*—Wood, Phillips, VanSanten, Hoffman & Ertel

[57] ABSTRACT

Contamination of the sampling portion of an observation well is avoided while providing axial float between the observation well cover and observation well liner by this observation well cover. The observation well cover includes a manhole ring that is set in a raised area of concrete. A manhole cover is fit on the ring and a liner cover fits underneath the ring. The liner cover has a trap to collect contamination. The walls of the screen cover slidingly mate with a wall and, of an 8-inch to 12-inch observation well liner and, respectively. The inner wall of the trap access hole slidingly mates with the outer wall of a 2-inch or a 4-inch observation well liner. This observation well cover provides axial float of the liner relative to the observation well cover while maintaining sealing integrity.

15 Claims, 2 Drawing Sheets

COVER FOR AN OBSERVATION WELL

FIELD OF THE INVENTION

This invention relates to a cover for an observation well used in monitoring underground tank leakage.

BACKGROUND OF THE INVENTION

In response to ecological concerns, the Federal Environmental Protection Agency (EPA) has developed regulations regarding leakage from underground storage tanks. To assist in the detection of leakage, observation wells and monitoring wells are installed near the tanks. An observation well is a well located within an area around the tank which was excavated during the installation of the tank. A monitoring well is a well that is outside the tank excavation area and extends below the water table.

Observation and monitoring wells have similar construction. The term "observation well" will be used herein to refer to both observation wells and monitoring wells.

Surface water above the tanks contaminated with hydrocarbons, e.g., rainfall mixing with surface spills from filling and emptying the tanks, can enter the well.

Observation wells can be used for detecting leakage other than that from underground storage tanks, for example leakage from landfills.

The first of these designs is shown in the American Petroleum Institute Industry Standards, API Recommended Practice 1615. In this design, a metal manhole with a metal manhole cover is set in concrete in a small raised area on the ground. A 2–12 inch polyvinyl chloride, PVC, pipe is used as the screen, casing or screen for the well and the pipe has 0.020 inch slots horizontally located in the lower two-thirds of the pipe. The pipe is permanently set in the concrete around the manhole. A seal or surface water barrier of consecutive layers of bentonite and sand or gravel are located below the concrete and may extend several feet below the surface. EPA regulations require that the well be sealed to the top of the ground that surrounds the well screen called the filterpack. The bentonite seal extends far into the filterpack. The uppermost slots are thus much below the filterpack rendering the well an inaccurate representation of the conditions of the site to be monitored. Bentonite looses its ability to seal when brought into contact with hydrocarbons.

A second observation well configuration specified by Shell Oil Company is shown in FIG. 1 of the drawings. In this configuration, a manhole with a manhole cover made of metal is set in concrete in a slightly raised mound in the concrete. The slotted, 4-inch PVC, polyvinyl chloride, casing is connected to the manhole by a screen which is connected to the casing by a stainless band clamp and also attached to the inner wall of the manhole.

A third type of observation well is manufactured by the applicant, The Boles Company, Inc. under the name Boles Test and Retrieval Sump®. In this observation well, a ribbed perforate steel screen, casing or liner being 2 to 12 inches in diameter is placed below the concrete. A unsealed plastic cap may be installed over the screen. A metal manhole with a metal manhole cover is set in a small raised area of the concrete. The manhole is not attached to the screen.

Seasonal fluctuations in the ground surface, particularly those associated with freezing and thawing, place great stress on the screen of an observation well which is permanently attached to the concrete. These wells are prone to having the screen separate from the concrete. The screen and the concrete are also subject to cracking and breaking.

In order that samples taken from an observation well are an accurate indication of the condition of the ground water and to prevent the well from being a path for contamination, it is critical that contamination not enter the interior of the well screen from the surface. Surface spills that occur and accumulate above the surface of the concrete have a tendency to leak through the manhole cover and into the observation well. Such contamination, and in particular petroleum or hydrocarbon components may seep through cracks in the concrete seal rendering it ineffective, may contaminate the underground water supply and, more importantly, provide an inaccurate representation of the condition of the storage tank.

The API well uses concrete as the seal to prevent leakage between the manhole ring and the well screen. Concrete is extremely prone to cracking and the potential for cracking is exacerbated by the permanent attachment of the well screen to the manhole ring, providing extra stress during freezing and thawing of the surface.

The Shell well uses a screen with band clamps to provide sealing between the manhole ring and well screen. This is an ineffective seal.

The current Boles Company, Inc. screen installation does not provide for a sealing beneath the manhole cover to avoid the egress of contamination from the surface.

Prior art observation well designs do not have an effective design to contain surface contamination and do not accommodate the heaving due to freezing and thawing.

The present invention is directed to maximizing the service life of an observation well by allowing relative motion between the observation well screen and the well cover. The invention further provides a more effective sealing means to prevent the egress of surface contamination into the well.

SUMMARY OF THE INVENTION

It is a principal object of this invention to provide a new and improved well cover for an observation well.

More particularly, it is an object of the invention to provide an effectively sealed well cover which permits axial float between the well screen and the well cover.

It is a further object of the invention to restrict unauthorized access to the well.

According to one facet of the invention, the foregoing object is realized by providing a manhole ring set in a paving layer above the upper end of a well liner. A manhole cover is located on the top of the manhole ring. A screen cover is permanently attached to the ring and extends downward past the upper end of the well screen. The screen cover has a recessed area that is used for a trap located near the access hole. The trap collects contamination that may have leaked through the cover of the observation well. The screen liner may be a one piece molded plastic construction. This configuration provides for relative motion between the well screen and the well cover to accommodate shifting that may occur during settlement, freezing and thawing. Surface contamination that seeps under the manhole cover is collected within the trap.

In a preferred embodiment of this facet of the invention, seals are located between the manhole ring and the manhole cover and also between the manhole ring and the screen cover. These additional seals provide more assurance that surface contamination will not enter the well.

According to a second facet of the invention, the foregoing object is realized by setting a manhole ring in a paving layer above the upper end of the well screen. A manhole cover is located on the manhole ring. A screen cover is secured to the manhole ring and has a U-shaped wall extending down from the central portion of the screen cover. The inside of the outer wall and the outside of the outer wall of the trap provide a sliding fit for an 8 inch to 12 inch liner. Sealing of contamination is again accomplished by a combination of seals, one being located between the manhole cover and the manhole ring and the other being located between the manhole ring and the screen cover. The combination of the two mentioned seals and the trap located in the screen cover serves to prevent contamination of the well. The sliding fit between the screen cover and the screen permits the relative motion of the screen and the cover during settlement, freezing and thawing.

Providing a monitoring well which utilizes this configuration of seals eliminates the need for deep layers of bentonite for sealing integrity This well cover configuration without a bentonite layer allows the well screen perforations to be closer to the ground surface providing a more efficient monitoring of the site.

In a preferred embodiment of this second facet the screen cover is made of a molded singular piece of polyethylene plastic.

In a preferred embodiment of the second facet of the invention, the trap of the screen cover has a tubular area extending upward from the bottom of the trap which has a tubular collar at the top of the tubular area in which to fit a plug. The inner wall of the tubular cylindrical area provides a sliding fit with a 4-inch or smaller well screen.

A preferred embodiment of this facet would be to provide a sealing plug to be located in the access hole of the screen cover.

Another preferred embodiment of this facet would be to place an electrical transducer below the sealing plug, with an electrical cable attached to the transducer at one end and attached to an electrical junction box located between the manhole cover and the screen cover at the other end.

Other objects and advantages will become apparent from the following specification taken in connection with the accompanying drawings.

DESCRIPTION OF THE PREFERRED EMBODIMENT

Figure 1:
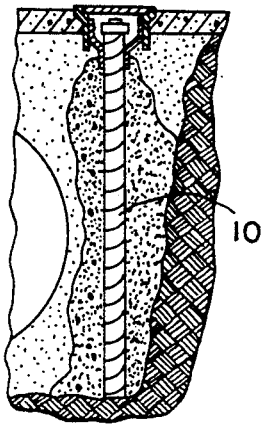
Fig. 1 PRIOR ART
FIG. 1 is a sectional view of an observation well according to the prior art.
Figure 2:
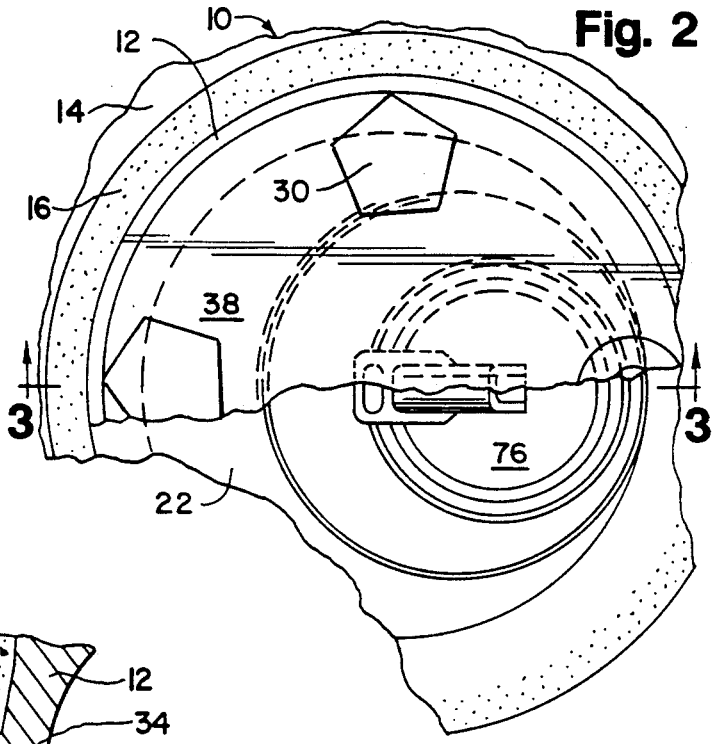
FIG. 2 is a top plan view of the improved observation well cover.

An exemplary embodiment of an observation well cover 8 according to the invention may be employed as illustrated in FIG. 2. However, it is to be understood the invention may be utilized to efficacy in either more sophisticated or more simplistic hardware.

An observation well 10, as illustrated in FIG. 2, has a manhole ring 12 that is set in concrete 14. The manhole ring 12 is set flush with a raised area 16, as shown in FIG. 3, of the concrete 14. The manhole ring 12 has a centrally located inner lip 18. An upper seal 20 is located on the top of the inner lip 18. A manhole cover 22 matingly fits the upper counterbore 24 of the ring 12 and rests on the upper seal 20. The manhole cover 22 is secured by two or more corkscrew locking cams 26 that matingly engage with the inner lip 18 of the manhole ring 12. The locking cams 26 which extend through the manhole cover 22 and have pentagon shaped heads 30.

Figure 3A:
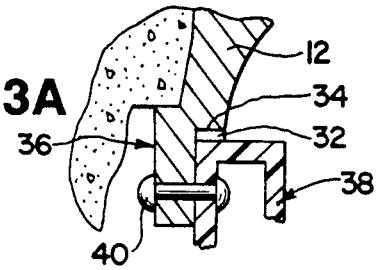
FIG. 3A is a fragmentary sectional view on an enlarged scale, taken generally along line 3—3 of FIG. 2.
Figure 3:
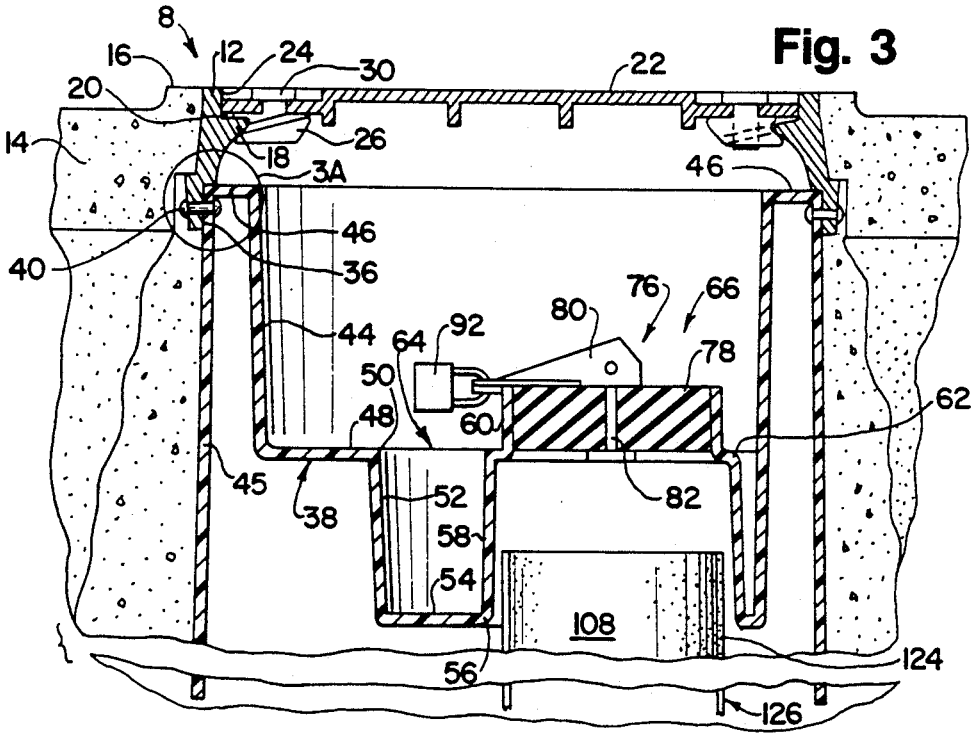
FIG. 3 is a sectional view taken on line 3—3, FIG. 2, showing the location of a 4-inch tubular perforate well screen.

Referring to FIG. 3A, a lower seal 32 is located under an inner lip 34 of a lower counterbore 36 of the ring 12. A screen cover 38 is matingly fitted to the lower counterbore 36 of the manhole ring 12 and rests against the lower seal 32 on the underside of the lip 34 of the ring 12. Rivets 40 extend through the ring 12 and the screen cover 38 to affix these two items.

Figure 5A:
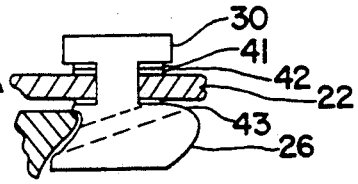
FIG. 5A is a fragmentary sectional view on an enlarged scale, taken generally along line 3—3 of FIG. 2.

Referring to FIG. 5A, a first brass washer 41 is located immediately underneath the heads 30. A Teflon washer 42 is located between the brass washer 41 and the manhole cover 22. A second brass washer 43 is located between the manhole cover 22 and the locking cams 26.

Again referring to FIG. 3, the screen cover 38 has an upper inner vertical wall 44 and an outer vertical wall 45 connected by an upper flat disc 46 which contacts the lower seal 32. The outer vertical wall extends approximately 15 inches downwardly from the upper flat disc 46. The upper inner vertical wall 44 is connected at the bottom by a middle flat disc 48 with an eccentric inside diameter 50. Extending downward from the inside diameter 50 of the disc 48 is a lower inner vertical wall 52. The lower inner vertical wall 52 is connected at the bottom by a lower flat disc 54 with an inside diameter 56 which is eccentric to vertical wall 52. Extending upward from the lower flat disc 54 is a tube 58. The tube 58 has a smaller tube 60 extending from an inner lip 62 at the top of the tube 58. A trap 64 is formed between the upper inside wall 52 and the outside of the tube 58 of the screen cover 38. The tube 60 serves as an access hole 66 for the observation well 10. The screen cover may have a one piece molded plastic construction.

An expansion plug 76 is matingly fitted to the inner wall of the smaller tube 60. This plug 76 consists of a pliable member 78 which is compressed by a cam lever 80 attached to a stud 82 extending through the pliable member 78 in order provide proper sealing of the sample portion 72 of the well 10. A hole 84 in an end 86 of the cam lever 80 and a hole 88 in a metal strip 90 affixed to the top of the pliable member 78 serve as attachment means for a padlock 92. When a sample of the fluid is taken in the observation well 10, the manhole cover 22, as shown in FIG. 3, first must be removed. A special wrench, not shown, is used to rotate the pentagon shaped head 30 of the cams 26 into an unlocked position. The manhole cover 22 is then lifted from the well 10. The plug 76 is then removed by unlocking the padlock 92 and then rotating the cam lever 80 upward separating the stud 82 from the lever 80 to relieve the pressure of the pliable member 78. The plug 82 is then pulled from the access hole 66. Samples are then drawn. The plug 76 is then placed in the access hole 66 and the cam lever 80 is then rotated downward compressing the pliable member 78. The manhole cover 22 is then placed on the lip 18 of the manhole ring 12 and the cam locking nut 26 are secured by the special wrench, not shown. The cams 26 permit the securing of the cover 22 without any radial alignment of the cover 22 to the ring 12.

Figure 4:
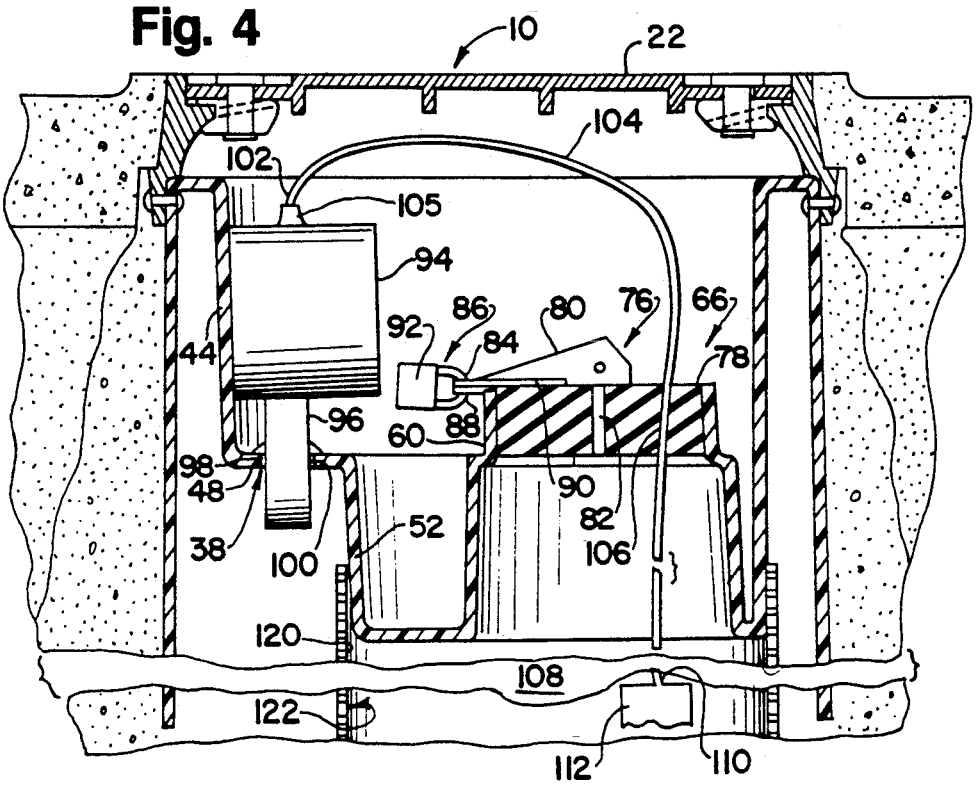
FIG. 4 is a sectional view taken along line 3—3, FIG. 2, showing the location of an 8-inch tubular perforate well screen.

Referring to FIG. 4, an electrical junction box 94 is attached to the top of the middle slot disc 48 of the screen cover 38 by means of a nipple 96 on the box 94, the nipple 96 protruding through a hole 98 in the disc 48 and sealed and secured by means of a grommet 100 located between the nipple 96 and the hole 98. One end 102 of an electrical cable 104 is attached to the junction box 94 by a water tight fitting 105. The cable 104 is sealingly fitted through a hole 106 in the pliable member 78 of the plug 76 and through the access hole 66 to a sampling portion 108 of the well 10. A second end 110 of the electrical cable 104 is attached to a transducer 112 which is used to monitor conditions within the well 10 and send an electrical signal (not shown) to the junction box 94. A variety of equipment may be attached electrically to the junction box 94 for monitoring the well 10.

The observation well 10 is designed to be compatible with any well screen. An inner wall 120 of an 8-inch tubular perforate screen, liner or casing 122 as shown in FIG. 4, is slidingly fit over the outside of the lower inner vertical wall 52 of the cover screen 38 to cover the sampling portion of the well 10. A 9-inch tubular screen (not shown) may alternatively fit outside of the vertical wall 52 of the cover screen 38 to cover the sampling portion 108 of the well 10.

Figure 5:
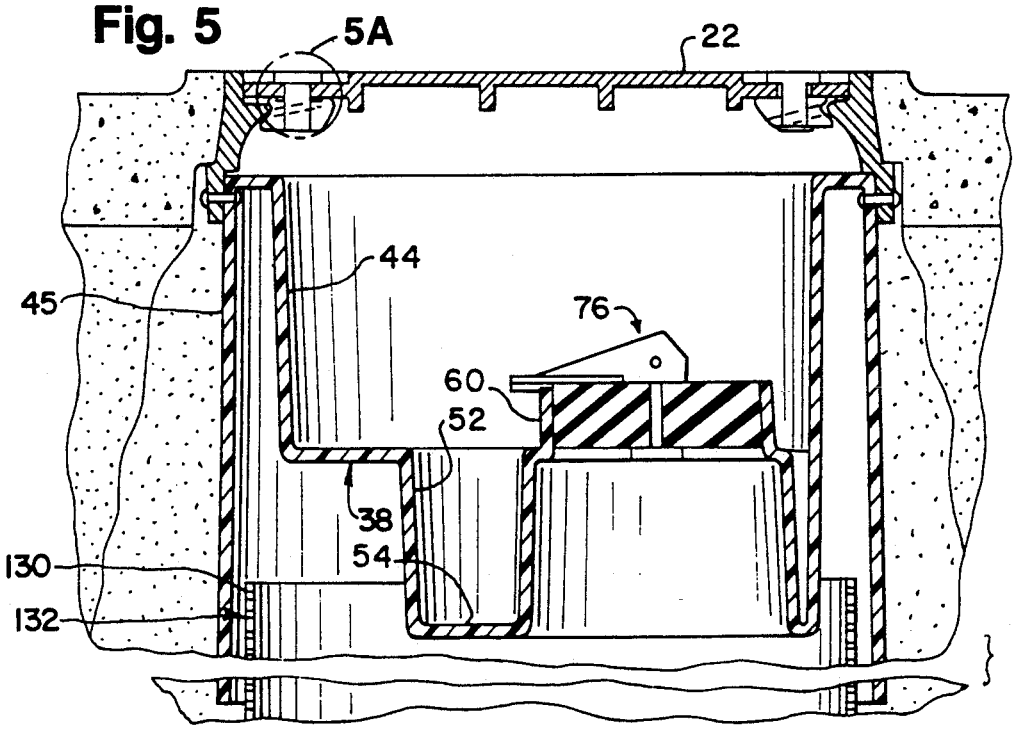
FIG. 5 is a sectional view taken on line 3—3, FIG. 2, showing the location of a 12-inch tubular perforate observation screen.

An outer wall 124 of a 4-inch tubular perforate screen 126, as shown in FIG. 3, is slidingly fit inside the cylindrical tube, 58 of the liner cover 38 to cover a sampling portion 108 of the well 10. A 2-inch tubular liner (not shown) may alternately fit inside the cylindrical tube 58 of the liner cover 38 to cover the sampling portion 108 of the well 10. An inner wall (not shown) of an 10-inch tubular perforate liner (not shown) is slidingly fit over the outside of the inner wall 44 of the liner cover 38 to cover the sampling portion 108 of the well 10. An outer wall 130 of a 12-inch tubular perforate liner 132 is, as shown in FIG. 5, slidingly fit to the inside of the outer wall 45 of the liner cover 38.

If a surface spill occurs, the upper seal 20 stops most contamination that may seep between the manhole ring 12 and the manhole cover 22. Whatever contamination that may seep between the upper seal 20 and the ring 12 or the seal 20 and the manhole cover 22 is collected in the trap 64. The lower seal 32 prevents the contamination from entering the sampling portion 108 of the well 10 between the manhole ring 12 and the liner cover 38. If sufficient contamination collects in the trap 64, the plug 76 prevents the contamination which spills over the smaller tube 60 from entering the sampling portion 108 of the well 10.

Contamination that may from time to time collect in the trap 64 can be removed by opening the manhole cover 22.

It can be readily appreciated that the 2-inch liner (not shown), the 4-inch liner 126, the 8-inch liner 122, the 9-inch liner (not shown), the 10-inch liner (not shown) or the 12-inch liner 132 have an ability to axially float relative to the liner cover 38 to accommodate whatever relative motion there might be below the surface when freezing, thawing or other surface conditions occur.

It can be easily understood that the use of the upper seal 20 to prevent contamination from seeping between the manhole ring 12 and the manhole cover 22 and entering the sampling portion 108 of the well 10 and the use the lower seal 32 to prevent contamination that may nevertheless seep under the manhole cover 22 from entering the well 10 between the manhole ring 12 and the liner cover 38, provide for an effective sealing means to prevent contamination of the well 10.

Since any sealing means may not always be completely effective, the use of the trap 64 to collect whatever contamination may enter the observation well 10 provides for a unique and effective means of containing the contamination and preventing its entry into the sampling portion 108 of the well 10 below.

The use of pentagonal heads 30 on the cams 26 for securing the manhole cover 22 requiring a special wrench (not shown) and the use of the padlock 92 to secure the plug 76 onto the access hole 66 prevents unauthorized access to the well 10 in general and unauthorized or fly dumping into the well in particular.

The use of corkscrew cams 26 to secure the manhole ring 12 avoids the need to align the cover 22 to the ring 12 easing the effort to remove and replace the cover 22 to perform monitoring functions. The action of the cams 26 turning against the inner lip 18 of the ring 12 during removal of the cover 22, separates the cover 22 from the ring 12 eliminating the need for extra tools to remove ice from the top of the ring 12 or to pry open a rusty cover 22.

The use of the expansion plug 76 in the access hole 66 provides further protective means to avoid contamination of the well 10.

The use of electrical junction box 94 and the provision for a transducer 112 provides for an electrical signal to monitor the well 10 insures proper assembly, and reduces the installation costs and time to provide electrical monitoring at a well site.

From the foregoing, it will be appreciated that this invention provides a means for effectively and inexpensively providing for accommodation of the heaving of the surface and the well cover 8 that occurs during settlement, freezing and thawing while, at the same time, providing an effective sealing mechanism to prevent contamination from entering the sampling portion 108 of the observation well 10.

Still other aspects, objects and advantages of the present invention can be obtained from a study of the specification, the drawings and the appended claims.

We claim:

1. In an observation well for detecting leakage from an underground storage tank, the well having a tubular perforate liner extending downwardly from the ground surface, the ground surface being covered with a layer of paving material, a well cover comprising:

a manhole ring set in said paving layer above the upper end of said liner;

a manhole cover received in said ring; and a liner cover secured to said ring and having a depending wall telescopically overlapped with the upper end of said liner, said liner cover having a trap to collect surface contamination whereby said well cover can accommodate axial, radial and tilt movement, between said cover and said liner while the trap prevents surface contamination from entering said observation well.

2. The well cover of claim 1 in which said depending wall of said liner cover is inside the well liner.

3. The well cover of claim 1 in which said depending wall of said liner cover is outside the well liner.

4. The well cover of claim 1 in which said depending wall has an inverted U cross section with an outer wall section for sliding movement outside a well liner of one diameter and an inner wall section for sliding movement inside a well liner of a lesser diameter.

5. The well cover of claim 1 in which said trap has a planar bottom surface bounded by an upstanding peripheral wall, with an access opening for the well in said planar surface, defined by an upstanding wall spaced, at least in part, inwardly of said upstanding peripheral wall.

6. The well cover of claim 5 including a closure plug which seals with the upstanding wall defining the access opening.

7. The well cover of claim 5 in which said upstanding peripheral wall extends above the bottom of the trap to telescopically receive a well liner within said access opening.

8. The well cover of claim 1 including a seal between said manhole ring and said liner cover.

9. The well cover of claim 1 including a seal between said manhole ring and the manhole cover.

10. The well cover of claim 9 including fasteners securing said liner cover to said manhole ring.

11. In an observation well for detecting leakage from an underground storage tank, the well having a tubular, liquid perforate well liner extending downward from the ground surface, the upper end of the liner being surrounded by a raised paved layer, a well cover, comprising:

a manhole ring set flush in said raised paved layer;

a manhole cover received in said ring; and a liner cover secured to the ring for preventing egress into the observation well of liquid contamination that seeps between said manhole cover and said ring, said liner cover having a vertical wall around its periphery and slidably fitted with the well liner.

12. The well cover of claim 11 in which said vertical wall of the liner cover is attached to a horizontal wall at the bottom of said vertical wall, whereby a trap is formed in the well cover to collect liquid contamination.

13. The well cover of claim 12 in which said liner cover has a tube extending vertically up from said horizontal wall through which samples can be taken from the well and whereby said trap is located between said tube and said vertical wall.

14. The well cover of claim 11 in which said vertical peripheral wall of said liner cover has an inverted U-shaped cross section to matingly fit with one of a plurality of well liners of different diameters.

15. In an observation well for detecting leakage from an underground storage tank, the well having a tubular perforate liner extending downwardly from the ground surface, the ground surface being covered with a layer of paving material, a well cover, comprising:

a manhole ring set in said paving layer above the upper end of said liner;

a manhole cover received in said ring;

a liner cover secured to said ring and having a peripheral wall extending downwardly past the upper end of said liner;

a seal between said ring and said liner cover; and a trap for surface water in said liner cover.

* * * * *